US010541094B1

(12) United States Patent
Yu et al.

(10) Patent No.: US 10,541,094 B1
(45) Date of Patent: Jan. 21, 2020

(54) VACUUM INTERRUPTER WITH RADIAL BELLOWS

(71) Applicant: Eaton Intelligent Power Limited, Dublin (IE)

(72) Inventors: Li Yu, Bridgeville, PA (US); Mark A. Juds, New Berlin, WI (US); Paul J. Rollmann, Menomonee Falls, WI (US); Andrew A. Rockhill, Waukesha, WI (US); Hongbin Wang, Novi, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/047,219

(22) Filed: Jul. 27, 2018

(51) Int. Cl.
*H01H 33/662* (2006.01)
*H01H 33/664* (2006.01)

(52) U.S. Cl.
CPC .... *H01H 33/66238* (2013.01); *H01H 33/664* (2013.01); *H01H 33/66207* (2013.01)

(58) Field of Classification Search
CPC ..... H01H 33/66207; H01H 33/66238; H01H 33/664; H01H 33/662; H01H 2033/6623; H01H 33/66; H01H 9/0038
USPC ..... 218/4, 10, 135, 134, 139, 118, 147, 136
See application file for complete search history.

(56) References Cited

U.S. PATENT DOCUMENTS 3,594,525 A 7/1971 Miller et al.
3,780,354 A 12/1973 Sharp
3,792,213 A 2/1974 Kane et al.
3,970,809 A 7/1976 Mitchell
3,983,345 A * 9/1976 Phillips ..... H01H 33/668 218/122
4,216,360 A 8/1980 Cherry et al.
4,233,480 A 11/1980 Hruda
4,272,661 A * 6/1981 Dethlefsen ..... H01H 33/666 218/142
4,587,390 A * 5/1986 Gray ..... H01H 33/666 200/400
4,746,777 A * 5/1988 Bialkowski ..... H01H 33/66261 218/136
5,854,729 A 12/1998 Degeneff et al.
6,864,456 B1 3/2005 Banghard et al.
9,431,198 B2 * 8/2016 Reuber ..... H01H 33/6606
9,842,713 B2 12/2017 Yu et al.
2005/0199590 A1 9/2005 Leusenkamp et al.
2015/0060409 A1 * 3/2015 Iitsuka ..... H01H 33/666 218/118

FOREIGN PATENT DOCUMENTS

GB 2154065 A 8/1985

* cited by examiner

*Primary Examiner* — Edwin A. Leon
*Assistant Examiner* — William A Bolton
(74) *Attorney, Agent, or Firm* — Fox Rothschild LLP

(57) ABSTRACT

A medium or low voltage circuit interrupter includes a housing with a first end cap, a second end cap that comprises a radial bellows, and one or more insulating sidewalls that extends from the first end cap to the second end cap. The end caps and one or more sidewalls provide a vacuum chamber. A fixed contact that extends through an opening of the first end cap and into the vacuum chamber. A moveable contact that extends through an opening of the second end cap and into the vacuum chamber. Multiple such interrupters may be electrically connected in series, positioned a single plane, and actuated by a single actuator.

24 Claims, 10 Drawing Sheets

VACUUM INTERRUPTER WITH RADIAL BELLOWS

BACKGROUND

Circuit breakers, sometimes referred to as circuit interrupters, include electrical contacts that contact each other to pass current from a source to a load. The contacts may be separated in order to interrupt the delivery of current, either in response to a command or to protect electrical systems from electrical fault conditions such as current overloads, short circuits, and low level voltage conditions.

In circuits where the current or voltage is sufficiently high, opening the contacts in a circuit breaker can create an arc. To avoid this result, circuit breakers may use an insulated gas, oil, or a vacuum chamber in order to extinguish the current and the arc. Vacuum circuit interrupters include a separable pair of contacts positioned within an insulated and hermetically sealed vacuum chamber. The chamber contains the vacuum and serves as a housing for the contacts and other components. Typically, one of the contacts is moveable and the other is fixed with respect to the housing, although in some vacuum interrupters both contacts may be moveable.

Vacuum circuit interrupters typically require equipment of substantial size in order to move the moveable contact and shield equipment from arc splatter. This can contribute to high cost, and it can limit the ability to use a vacuum interrupter in low and medium voltage applications. In addition, the use of vacuum circuit interrupters poses challenges in medium voltage applications, which require a relatively high opening speed and response time.

This document describes methods and systems that are intended to address some or all of the problems described above.

SUMMARY

In some embodiments, a circuit interrupter includes a housing that forms a vacuum chamber. The housing includes a first end cap, along with a second end cap that includes a radial bellows. An insulating sidewall made of glass, ceramic or other insulating material extends from the first end cap to the second end cap. A fixed contact extends through an opening of the first end cap and into the vacuum chamber. A moveable contact extends through an opening of the second end cap and into the vacuum chamber.

Optionally, the radial bellows may include concentric circular ridges that encircle the moveable contact. The second end cap also may be made of a metal, and it may include a wall that extends perpendicular to the radial bellows and that is fixedly connected to the insulating sidewall of the housing.

Optionally, the circuit interrupter may include a shield that is positioned in the housing to surround at least a portion of the fixed contact in the housing, a full distance of a gap formed when the fixed contact and the moveable contact are separated, and at least a portion of the moveable contact.

Optionally, the first end cap is made of metal, and it may include a wall that is parallel to the fixed contact and that is fixedly connected to the insulating sidewall of the housing. Also, the housing may include a rim that encircles the first end cap, and the first end cap may include a wall that extends through the rim and into the housing to form a wall of the vacuum chamber.

In an alternate embodiment, a circuit interrupter includes multiple vacuum circuit interrupter devices positioned proximate to each other, such as on a single plane. Each of the vacuum circuit interrupters includes a fixed contact and a movable contact, and the vacuum circuit interrupters are electrically connected to each other in a series between an input terminal and an output terminal. A connecting member that comprises an insulating material is attached to the movable contacts of each of the vacuum circuit interrupters. An actuator is connected to the connecting member. The actuator is configured to move the connecting member in a first direction to close each of the interrupters, and to move the connecting member in a second direction to open each of the interrupters.

Optionally, a first conductive link member may be is configured to be electrically connected to the input terminal and to either the fixed contact or the moveable contact of a first one of the vacuum circuit interrupters in the series. A second conductive link member may be configured to be electrically connected to the output terminal and to either the fixed contact or the moveable contact of a final one of the vacuum circuit interrupters in the series. Additional conductive link members may be included, each of which electrically connects either the fixed contacts or the moveable contacts of a pair of adjacent vacuum circuit interrupters in the series.

Optionally, the circuit interrupter may include an insulating chamber in which the vacuum circuit interrupters are contained, along with a set of bushings, through each of which one of the movable contacts or one of the fixed contacts extends from the insulating chamber.

Optionally, each vacuum circuit interrupter device may be a low voltage circuit interrupter, and the series of vacuum interrupter devices may collectively provide a medium voltage circuit interrupter.

Optionally, one or more of the vacuum circuit interrupter devices may include a housing that provides a vacuum chamber and that includes a first end cap, and a second end cap with a radial bellows. An insulating sidewall made of glass, ceramic or other insulating material extends from the first end cap to the second end cap. The interrupter's fixed contact may extend through an opening of the first end cap and into the vacuum chamber, and the interrupter's moveable contact may extend through an opening of the second end cap and into the vacuum chamber. The radial bellows may include concentric circular ridges that encircle the moveable contact of the vacuum circuit interrupter. The first end cap may be made of metal, and it may include a wall that is positioned parallel to the fixed contact and that is fixedly connected to the insulating sidewall of the housing. The second end cap also may be made of metal, and it may include a wall that extends perpendicular to the radial bellows and that is fixedly connected to the insulating sidewall of the housing. A shield may be positioned in the housing to surround at least a portion of the fixed contact in the housing, a full distance of a gap formed when the fixed contact and the moveable contact are separated, and at least a portion of the moveable contact. The housing also may include a rim that encircles the first end cap, and the first end cap may include a wall that extends through the rim and into the housing to form a wall of the vacuum chamber.

DETAILED DESCRIPTION

As used in this document, the singular forms "a," "an," and "the" include plural references unless the context clearly dictates otherwise. Unless defined otherwise, all technical and scientific terms used in this document have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a direction in which those components are so oriented with respect to each other. The relative orientations of the components may be reversed, or the components may be on the same plane, if the orientation of the structure that contains the components is changed. The claims are intended to include all orientations of a device containing such components.

In this document, values that are described as being approximate, or that are characterized as being "approximately" a value, are intended to include a range of plus or minus 10 percent around the value.

Figure 1:
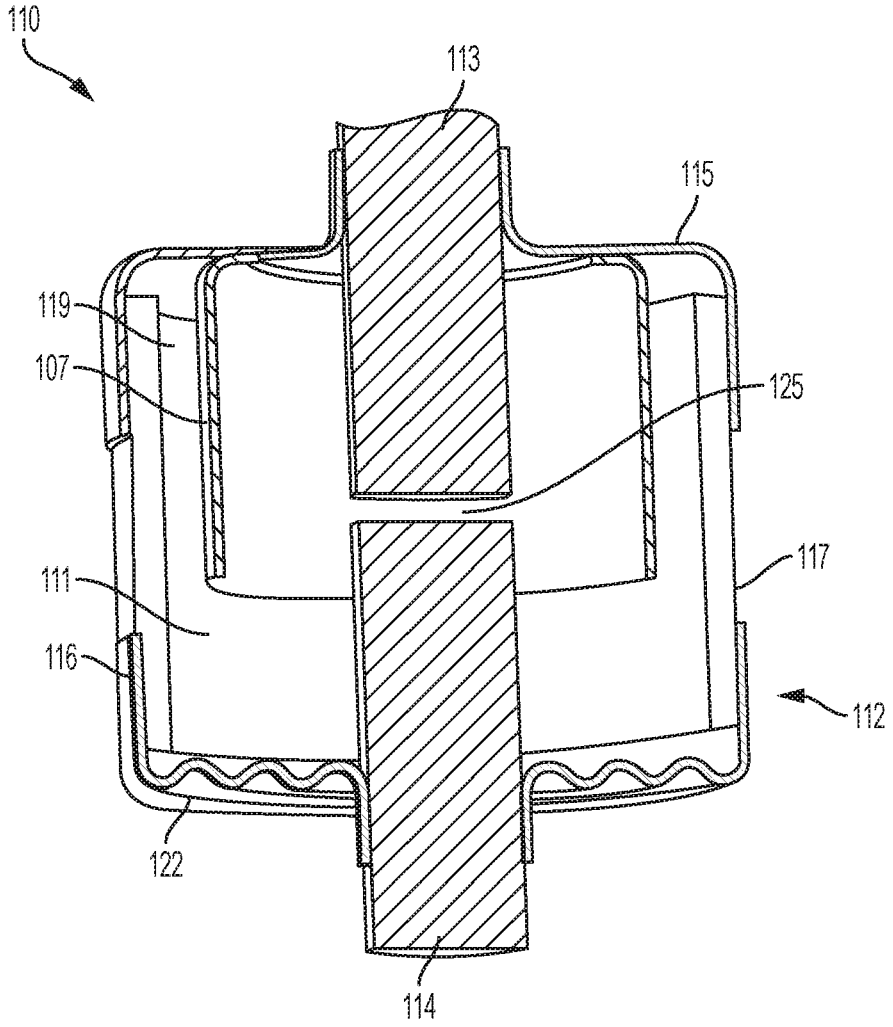
FIG. 1 illustrates a first embodiment of a vacuum circuit interrupter.

FIG. 1 illustrates example components of an embodiment of a vacuum circuit interrupter that includes a vacuum chamber 111 that is included within a sealed vacuum chamber housing 112. The shield 107 may be made of metal such as stainless steel, copper, alloys of these and/or other metals. A fixed contact 113 and a moveable contact 114 extend into top and bottom portions, respectively, of the vacuum chamber housing 112. The fixed and moveable contacts 113, 114 may be formed of copper, copper chromium, copper tungsten, a copper alloy or another suitable conductive material. The fixed and moveable contacts 113, 114 may be connected to pass current, or separated to form a gap 125 that interrupts and/or prevents current from passing between the contacts. The housing also includes an insulating sidewall 117 made of ceramic, glass, or another insulating material. In the embodiment shown, the vacuum chamber housing 112 is cylindrical and thus contains a single cylindrical insulating sidewall 117. However, multiple sidewalls may exist in embodiments that have other shapes such as rectangles, squares, ovals and the like.

In FIG. 1, a first end cap 115 includes an opening that surrounds the fixed contact 113, as well as one or more walls that in this embodiment extend in a direction that is perpendicular to the longest dimension of the fixed contact 113 along, up to or into the sidewall 117 of the vacuum chamber housing 112. The first end cap 115 may be made of metal such as stainless steel, copper, alloys of these and/or other metals. The shield 107 includes a section that extends into the housing 112 from the first end cap 115. In an alternate embodiment shown in FIG. 2, instead of having the first end cap's wall positioned to extend along, into or to the sidewalls of the housing, the vacuum chamber housing 212 includes an insulating sidewall 217 and a rim 220 made of the same or similar insulating material as the insulating sidewall 217 and/or end caps 215 and 216. The first end cap 215 also functions as a shield as it extends into an opening of the rim via a sealing joint 221. In this way the first end cap may contain part of the vacuum chamber 211, and the sidewall(s) 217 of the housing 212 may contain the rest of the vacuum chamber 211. The fixed contact 213 extends into the first end cap 215, and the moveable contact 214 extends into the second end cap 216. The fixed and moveable contacts 213, 214 may be connected to pass current, or separated to form a gap 225 that interrupts and/or prevents current from passing between the contacts.

Returning to FIG. 1, a second end cap 116 is positioned on an end of the housing that is opposite the first end cap 115. The second end cap 116 may be made of metal such as stainless steel, copper, alloys of these and/or other metals. The second end cap 116 includes an opening that surrounds the moveable contact 114. The second end cap 116 also may include one or more walls that extend into, up to or along the sidewall of the housing. The portion of the second end cap 116 that surrounds the moveable contact 114 is in the form of a radial bellows 122 that is flexible, with multiple concentric circular ridges (for example in the form of waves) that surround the opening that holds the moveable contact 114 so that the radial bellows 122 may be stretched outward to form a cone, and return to a planar position, as a driving mechanism (not shown) moves the moveable contact 114 away from and back toward the fixed contact 113. A similar structure is included in the embodiment shown in FIG. 2, where the second end cap 216 includes a radial bellows 222 with an opening that surrounds the moveable contact 214.

The distance of displacement of the moveable conductor (i.e., gap 125 in FIG. 1 or 225 in FIG. 2) need not be large since the interrupter has a vacuum and will be used in low voltage (approximately 1000V or less) or medium voltage (over 1 KV to approximately 15 KV) applications. For example, in some embodiments the gap may be approximately 0.039 inches. In other embodiments, the gap may be 0.01 inches to 0.5 inches. Other gap sizes may be used. Thus, the radial bellows can save costs and reduce size of the interrupter as compared to prior art vacuum interrupters.

Figure 2:
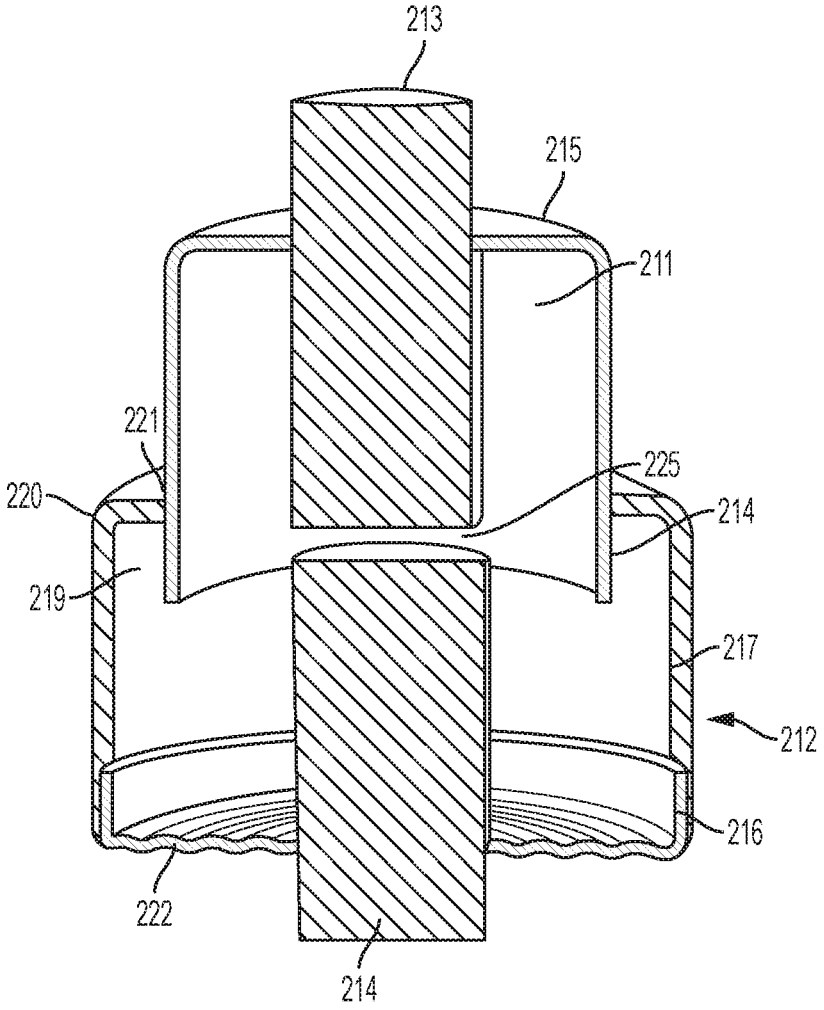
FIG. 2 illustrates a second embodiment of a vacuum circuit interrupter.

In the embodiments shown in FIGS. 1 and 2, to manufacture the device the end caps may be connected to the insulating sidewall material by a brazing process or by another suitable process that will fuse or otherwise fixedly connect the end caps to the sidewall to form the housing.

Although the embodiments shown in FIGS. 1 and 2 illustrate that the moveable contact and the bellows are on the bottom of the housing, this disclosure includes embodiments in which those feature are positioned on the top of the housing, with the fixed contact and its associated end cap being positioned at the bottom of the housing.

Returning to FIG. 1 (but equally applicable to the embodiment of FIG. 2), when the fixed and moveable contacts 113, 114 are in the closed position, the connection point is positioned within the shield. The fixed contact 113 extends through the first end cap and into the vacuum chamber 111. The fixed contact is fully contained within the shield 107 in the embodiment shown, although in other embodiments (such as alternatives that will be discussed below) the fixed contact may be partially contained within the shield. The moveable contact 114 extends through the second end cap, first through a portion of the chamber that does not include the shield 107, and then further into the vacuum chamber 111 so that the moveable contact is partially received by the shield 107.

When the fixed and moveable contacts 113, 114 are separated by movement of the fixed contact 113 away from the moveable contact 114, the gap 125 formed by the separation is also completely contained within the shield 107. This means that the open end of the vacuum chamber that receives the moveable contact will always be positioned along the longest lateral dimension of the moveable contact.

The shield 107 surrounds the gap 125 and extends from the first end cap 115 to provide a shield region 119 that is positioned laterally in the housing along the entire gap and at least some parts of both contacts in the vacuum chamber 111. The shield 107 may be made of metal such as stainless steel, copper, alloys of these and/or other metals. The shield 107 and shield region 119 protect the insulating sidewall 117 of the housing from electrically conductive spatter that may form during arcing interruption of the circuit.

The shield 107 extends toward but does not reach the bellows 122. Otherwise, the interrupter would be short-circuited. The length of the shield 107 depends on where the contact gap 125 is located, and it inhibits metal vapor from being sprayed to the sidewall 117, which would cause a short circuit from end cap to end cap. Additional configurations and positions of the shield will be discussed below in the context of FIGS. 6-10.

Figure 3:
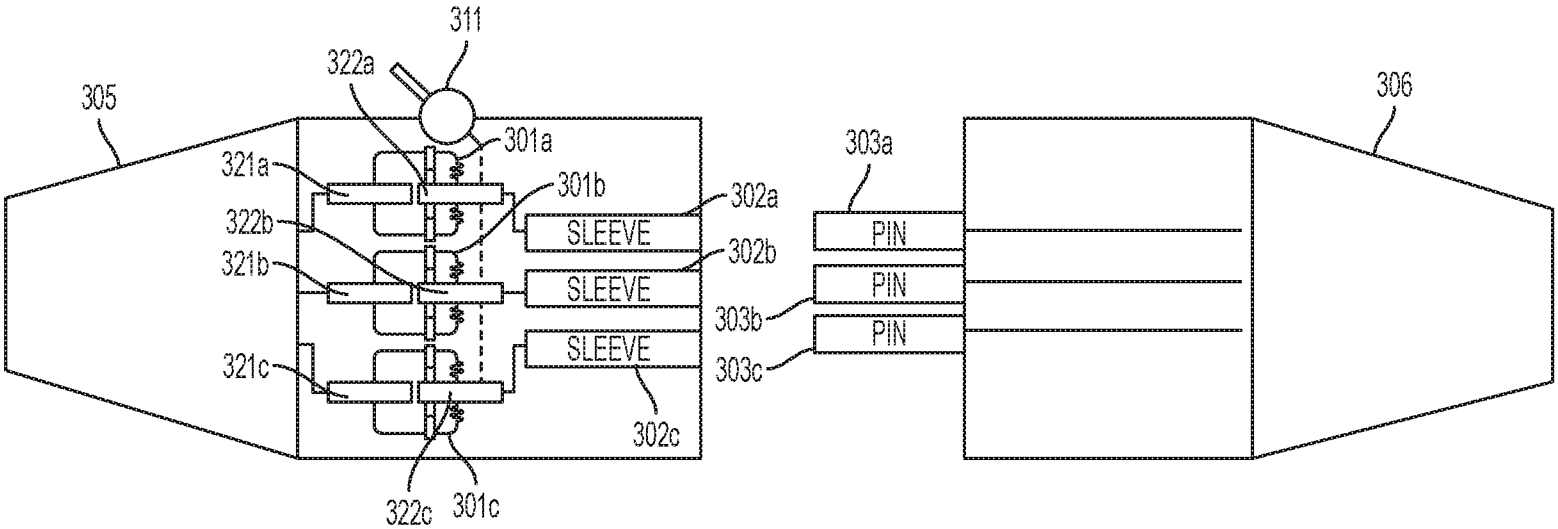
FIG. 3 illustrates components of a three-phase connector with integral switch that includes vacuum circuit interrupters such as those shown in this document.

FIG. 3 illustrates how vacuum interrupters such as those shown in FIGS. 1 and 2 may be used in a three-phase connector with integral switch to connect (when closed) and interrupt (when open) a circuit between a power source (line) 305 and a load 306 such as a motor, light system or other device that consumes power. Three vacuum interrupters 301*a*-301*c* are positioned so that one interrupter is present in each phase of a three-phase circuit. Each vacuum interrupter 301*a*-301*c* includes a fixed contact 321*a*-321*c* and a moveable contact 322*a*-322*c*. A mechanism 311 is connected to the moveable contact 322*a*-322*c* of each interrupter so that movement of the mechanism 311 in a first direction will move the moveable contacts away from their respective fixed contacts, and movement of the mechanism 311 in a second direction will move the moveable contacts toward their respective fixed contacts. The moveable contact 322*a*-322*c* of each vacuum interrupter is connected to a conductive sleeve 302*a*-302*c*, which is positioned and shaped to receive a conductive pin that is electrically connected to the load 306. In the embodiment shown the moveable contact of each vacuum interrupter is connected to a conductive sleeve, while the fixed contact of each interrupter is connected to the power line. However, this arrangement may be reversed so that the fixed contact connects to the conductive sleeve and the moveable contact is connected to the power line.

Figure 4:
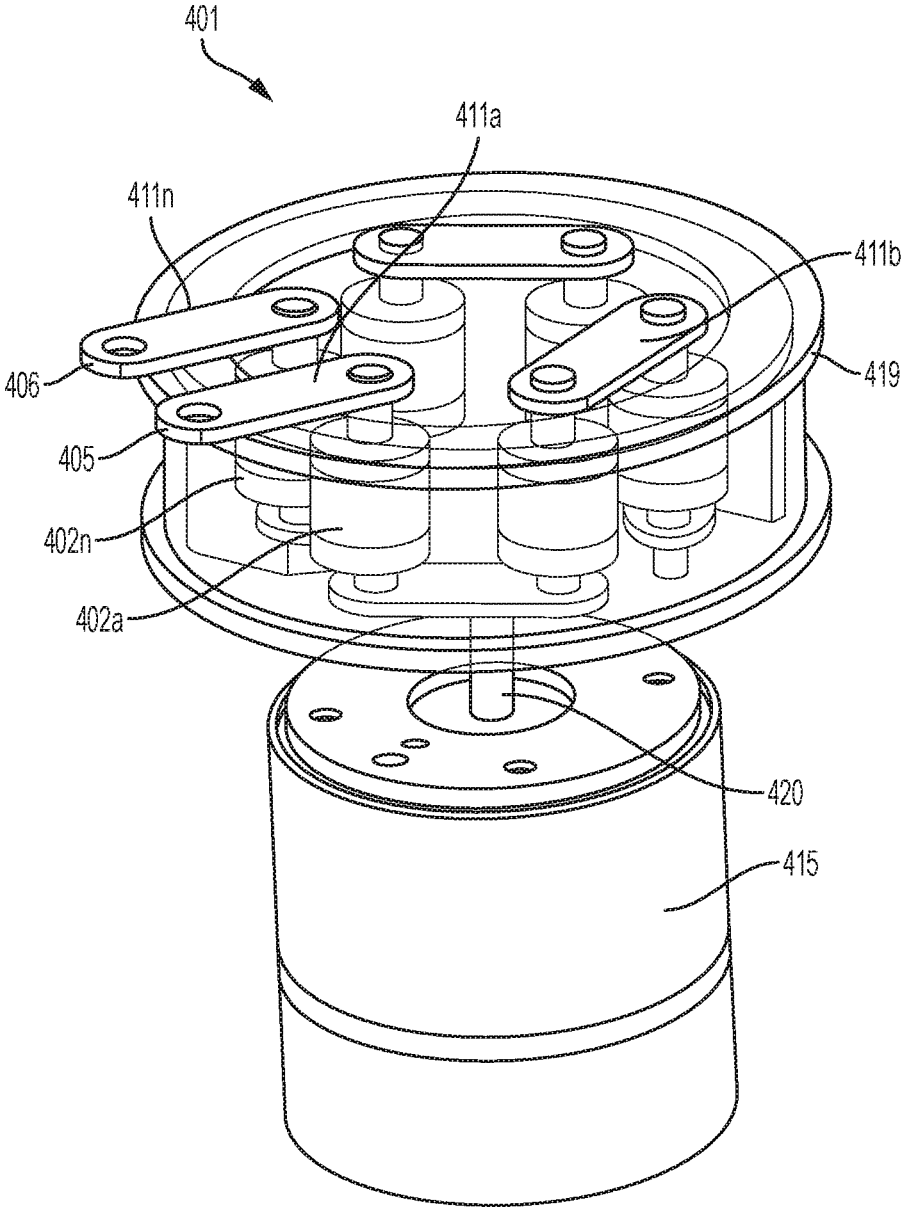
FIG. 4 illustrates a circuit interrupter that is made of an array of vacuum circuit interrupter.
Figure 5:
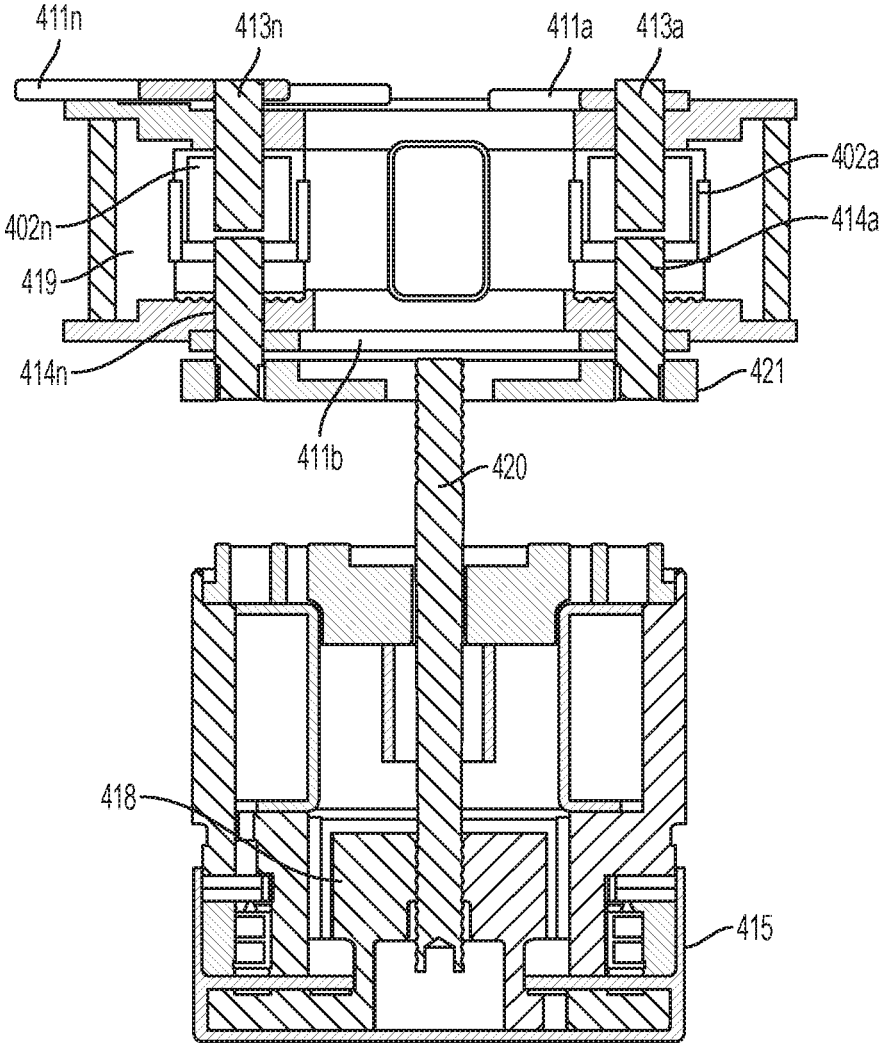
FIG. 5 is a cut-away view showing certain internal components of the circuit interrupter of FIG. 4.

The small size of the vacuum interrupters such as those shown in FIGS. 1 and 2 provide a compact structure in which multiple interrupters may be electrically connected in series, while being positioned near each other on a single plane to form a compact vacuum interrupter array. FIG. 4 illustrates a vacuum interrupter array 401 that includes a set of vacuum interrupters 402*a* . . . 402*n* positioned proximate to each other on a single plane and that are electrically connected in series. FIG. 5 illustrates a cut-away view of the example of FIG. 4. The example shown in FIGS. 4 and 5 illustrates six vacuum interrupters in a circular arrangement, but any number of vacuum interrupters may be used, in any type of single plane or multiple plane arrangement such as an array, the shape of a box or triangle, or any other arrangement. Optionally, the vacuum interrupters may be contained within a chamber 419 that has insulating side and/or top walls or supports and that is also maintained in a vacuum, or which may be partially or fully filled with air, an insulating gas such as sulfur hexachloride or argon, or a solid insulating material. The fixed and moveable contacts will extend from the chamber 419 via a bushing that insulates the conductive contacts from the insulating sidewalls of the chamber 419.

A circuit is formed from a power source via an input terminal 405 to a load via an output terminal 406 through all of the vacuum interrupters 402*a* . . . 402*n* by a set of conductive link members 411*a* . . . 411*n*. A first conductive link member 411*a* connects the input terminal 405 to a one of the contacts of the first vacuum interrupter 402*a* in the series. A final conductive link member 411*n* connects one of the contacts of a final vacuum interrupter 402*n* to the output terminal 406. Each additional conductive link member (e.g., 411*b*) connects either the fixed contacts 413*a* . . . 413*n* or the moveable contacts 414*a* . . . 414*n* of a pair of adjacent vacuum interrupters to each other so that, for each vacuum interrupter, the interrupter's fixed contact is connected to the fixed contact of an adjacent vacuum interrupter, and the interrupter's moveable contact is connected to the moveable contact of a different adjacent vacuum interrupter.

An actuator 418 is positioned in a housing 415 under (or over) the side of the array 401 from which the interrupters' moveable contacts 414*a* . . . 414*n* extend. The moveable contacts 414*a* . . . 414*n* are connected to a connecting member 421 such as a disk, plate, set of interconnected bars or other structure that connects all of the moveable contacts 414*a* . . . 414*n* to a connecting rod 420. The connecting member 421 will be made of an insulating material such as glass, ceramic, fiberglass, PVC, or a rigid laminate. The actuator 418 may move the connecting rod 420 and connecting member 421 toward the array 401 to close the interrupters, and the actuator 418 may move the connecting rod 420 and connecting member 421 away from the array 401 to open the interrupters. Example actuators may include, for example, solenoids and other electromagnetic actuators, as well as spring type mechanisms.

The array structure described above thus permits small vacuum interrupters such as those described above to be used in medium voltage applications, where the voltage drop across the array of series-connected interrupters is larger than would be possible with only a single vacuum interrupter. The array structure described above also can provide faster switching as compared to a single, larger interrupter, because of contact gap that would be required at a particular voltage is spread among the multiple smaller conductors of the array.

FIGS. 6-10 illustrate various possible positions of a shield in a circuit interrupter such as those described above in the context of FIGS. 1 and 2.

Figure 6:
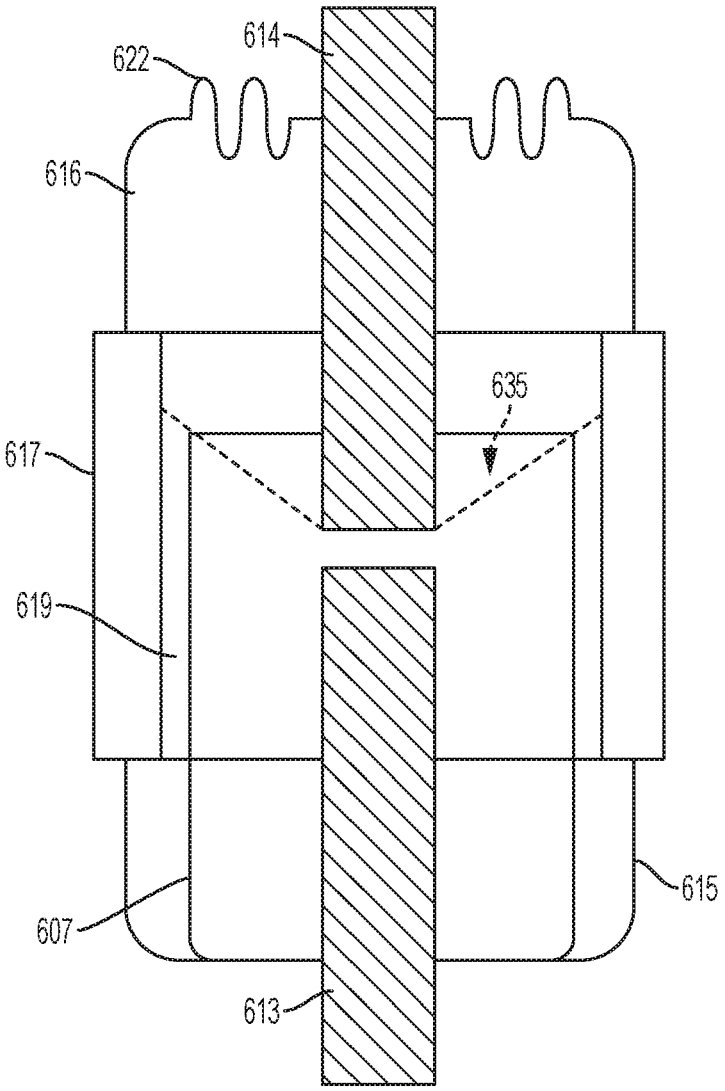
FIGS. 6-10 illustrate embodiments of vacuum circuit interrupters similar to those shown in FIGS. 1 and 2 with various configurations and locations of a shield to protect the interrupter's insulating housing from spatter.

FIG. 6 illustrates a positioning of the shield 607 in a location similar to that of FIG. 1. In FIG. 6, the shield 607 extends from a first end cap 615 toward a second end cap 616. The fixed contact 613 extends into the housing from the first end cap 615. The movable contact 614 extends into the housing from the second end cap 616 and through the radial bellows 622. An insulating sidewall 617 extends from the first end cap 615 to the second end cap 616. The shield 607 surrounds the gap between the movable contact 614 and fixed contact 613 to provide a shield region 619 between the shield 607 and the insulating sidewall 617. In this way the line of spatter 635, representing the area in which arc spatter is expected to extend, will hit the shield 607 rather than the sidewall 617.

Figure 7:
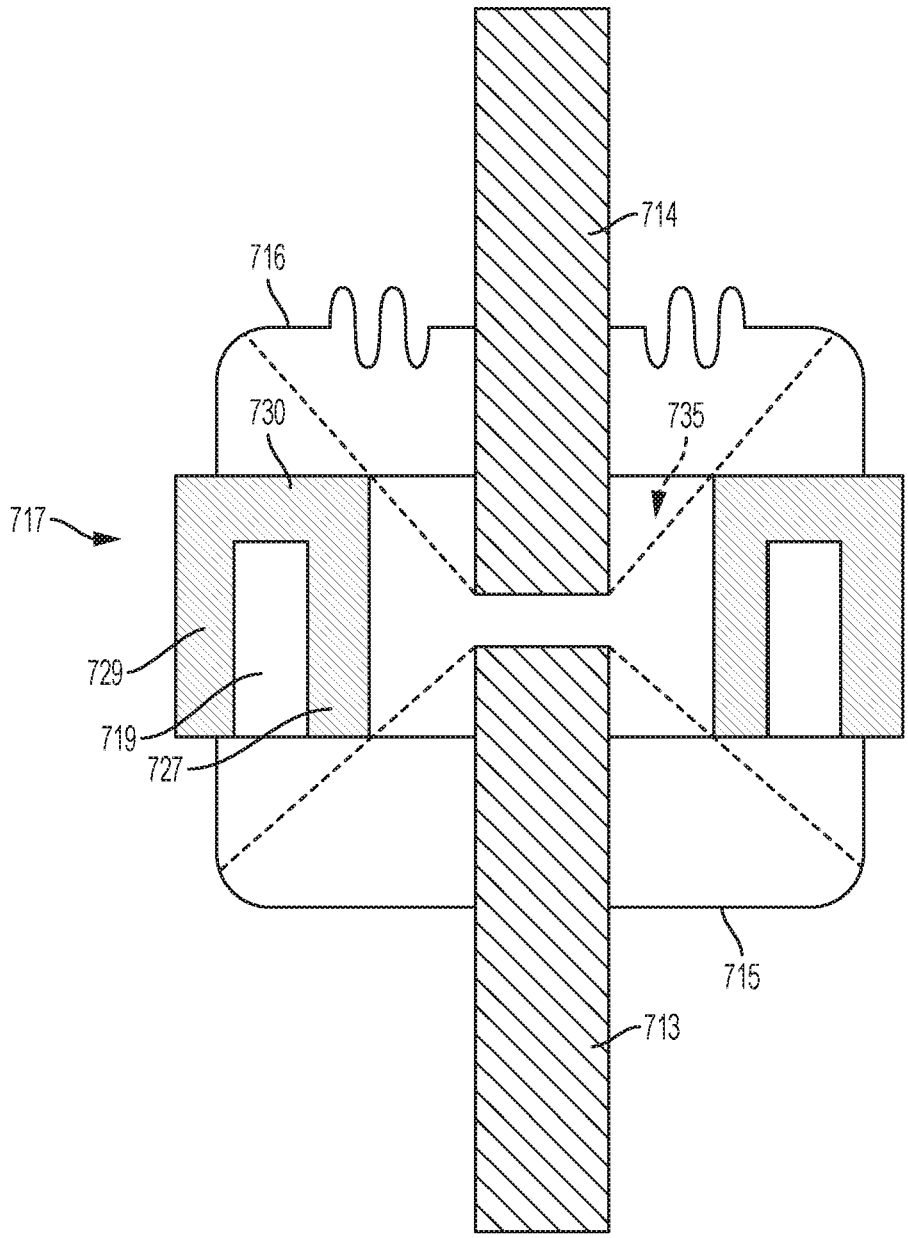

FIG. 7 illustrates an embodiment in which the sidewall 717 includes an inner member 727 and a parallel outer member 729 that are connected to each other by a connecting member 730. The inner member 727 is positioned along the metal shield 707, and the shield region 719 is formed between the inner member 727 and the outer member 729. In FIG. 7, the shield 707 may be, but need not be, connected to the end caps 715 and 716 because it is held in place by the inner member 727 of the sidewall 717. Rather than having a separate metal shield, the inner member 727 and the connecting member 730 of the sidewall 717 serve as the shield to protect the outer member 729. The shield provided by the inner member 727 still surrounds the gap between the movable contact 714 and fixed contact 713 and has a length that is sufficient to block the line of spatter 735 so that arc spatter, will hit the inner member 727 rather than the sidewall 717.

Figure 8:
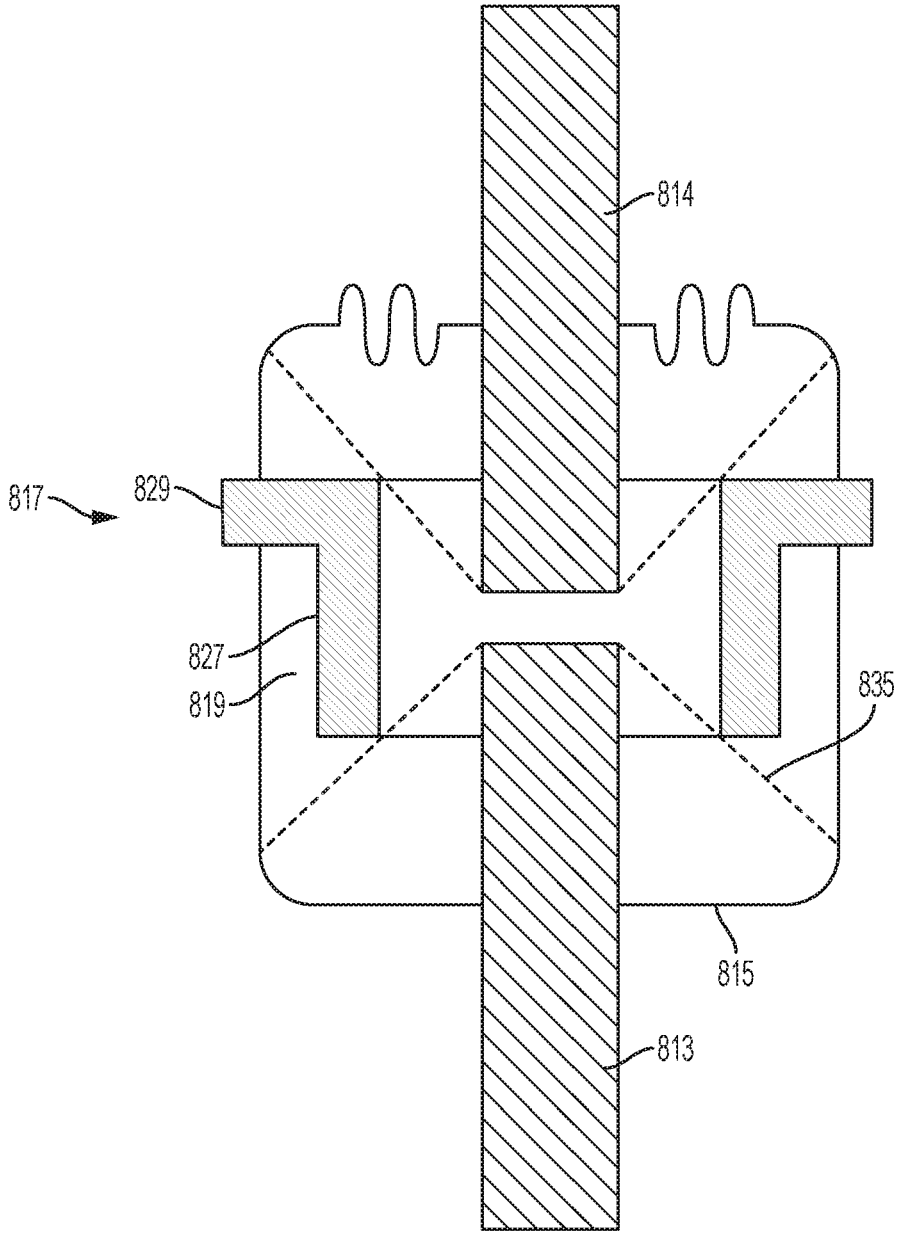

FIG. 8 illustrates an embodiment similar to that of FIG. 7, except instead of the U-shaped sidewall 717 of FIG. 7, the sidewall 817 of FIG. 8 is L-shaped, with a first (outer) member 829 positioned between the end caps 815 and 816 and extending into the housing, and a second (inner) member 827 connected to the outer member 829 to form the L-shape. The second (inner) member 827 is perpendicular to the outer member 829 and parallel to the moving and fixed contacts 814, 813. The inner member 827 is the shield, and the shield region 819 is formed between the inner member 827 and one of the end caps 815. A portion of the outer member 829 that extends into the housing also serves as a shield region to protect the outermost portion of the outer member 829 from arc spatter. Rather than having a separate metal shield, the inner member 827 and the outer member 829 of the sidewall 817 serve as the shield to protect the housing.

Figure 9:
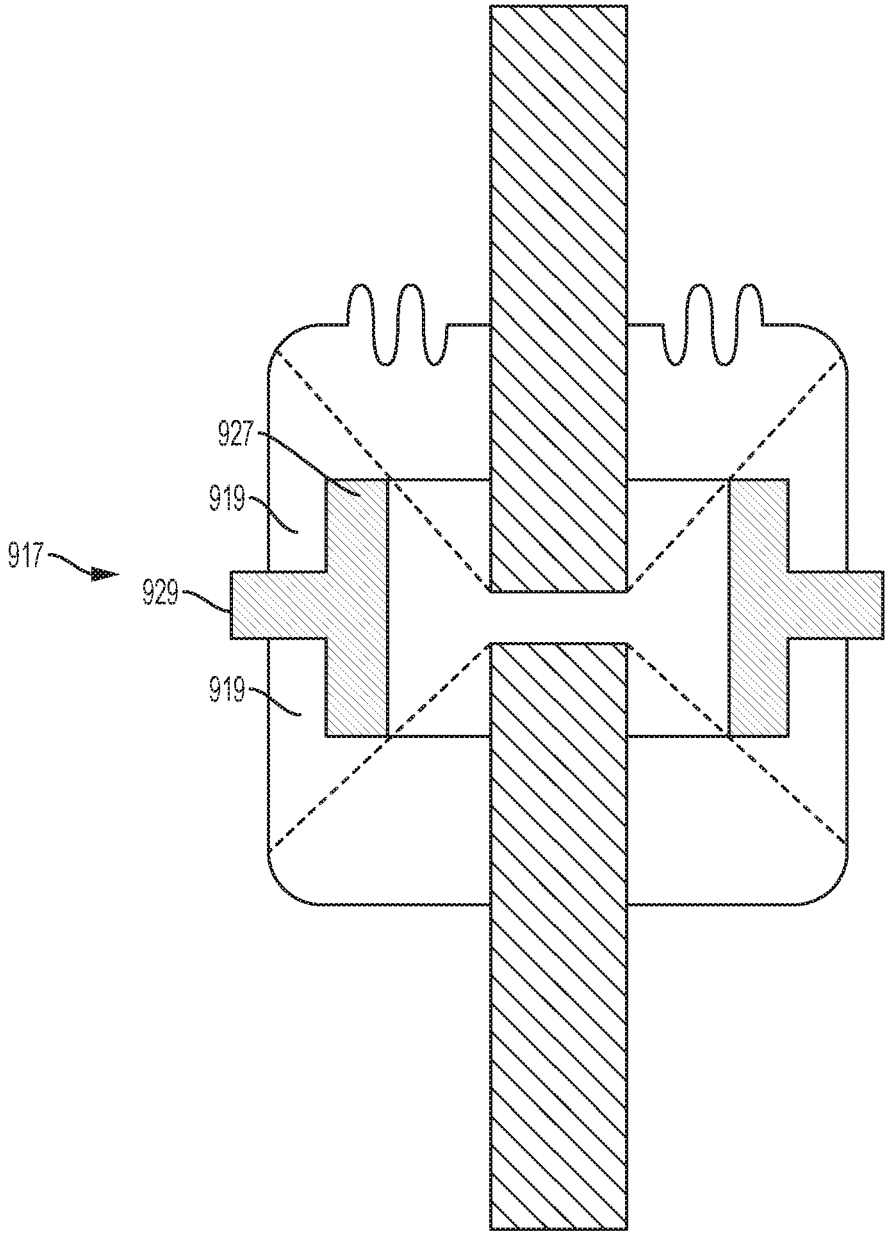
Figure 10:
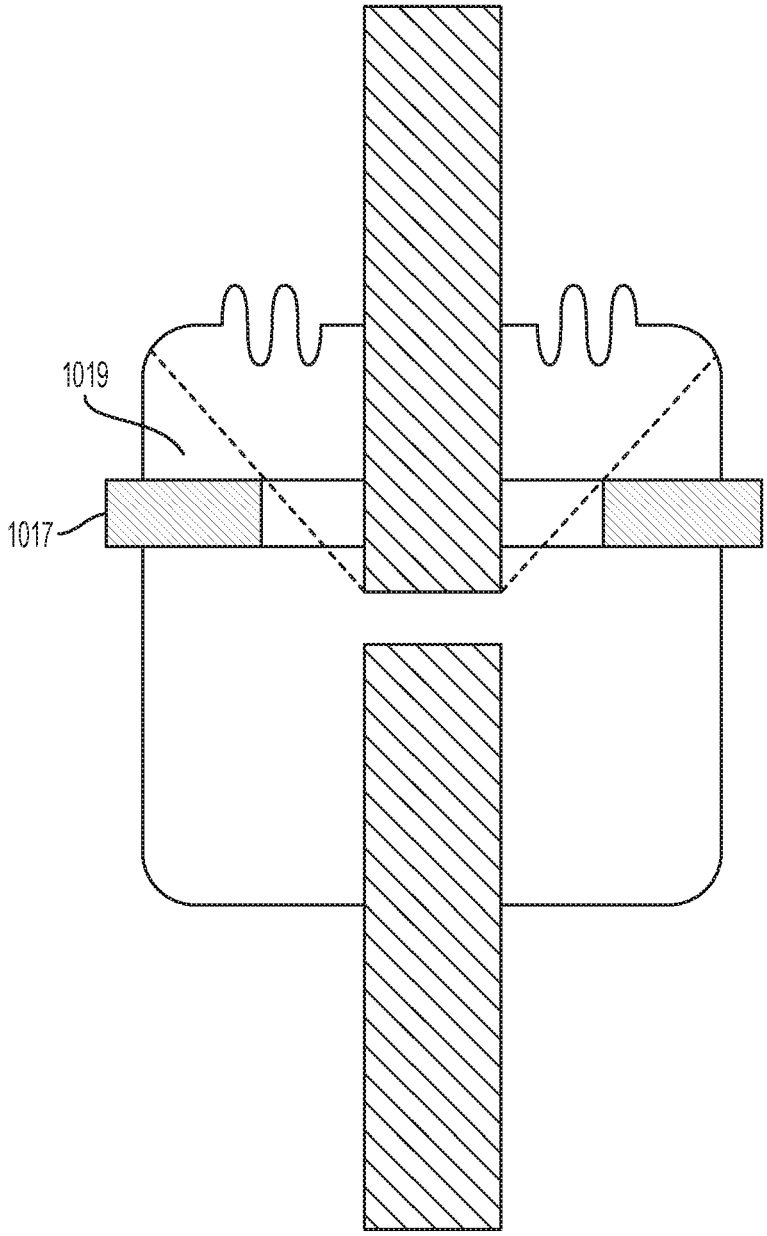

FIG. 9 illustrates a variation the embodiment of FIG. 8 in which the sidewall 917 is T-shaped, with a rim serving as the outer member 929 extending from the inner member 927 in a perpendicular direction so that the shield region 919 is positioned both above and below the outer member 929. FIG. 10 illustrates a variation in which the sidewall 1017 is a single member that extends into the housing. A portion of the sidewall 1017 that extends into the housing also serves as a shield to protect the top portion of the sidewall 1017 from arc spatter. Rather than having separate metal shield the innermost portion of the sidewall 1017 serves as the shield to protect the uppermost portion of the sidewall 1017.

The various embodiments described in this document may provide several benefits not found in prior art switching system. For example, the use of low voltage vacuum interrupter arrays connected in series to provide a higher-level low voltage or medium voltage switching apparatus can help to achieve higher opening speed, longer life and improved cost efficiency as compared to many prior switching systems.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A circuit interrupter, comprising:

a plurality of vacuum circuit interrupters positioned proximate to each other in a planar array structure, wherein each of the vacuum circuit interrupters includes a fixed contact and a movable contact, and wherein the vacuum circuit interrupters are electrically connected to each other in a series between an input terminal and an output terminal;

a connecting member that comprises an insulating material and that is attached to the movable contacts of each of the vacuum circuit interrupters; and an actuator that is connected to the connecting member;

wherein the actuator is configured to move the connecting member in a first direction to close each of the interrupters, and to move the connecting member in a second direction to open each of the interrupters, and wherein each vacuum circuit interrupter is a low voltage circuit interrupter, and the series provides a medium voltage circuit interrupter.

2. The circuit interrupter of claim 1, further comprising:

a first conductive link member that is configured to be electrically connected to the input terminal and to either the fixed contact or the moveable contact of a first one of the vacuum circuit interrupters in the series;

a second conductive link member that is configured to be electrically connected to the output terminal and to either the fixed contact or the moveable contact of a final one of the vacuum circuit interrupters in the series; and a plurality of additional conductive link members, each of which electrically connects either the fixed contacts or the moveable contacts of a pair of adjacent vacuum circuit interrupters in the series.

3. The circuit interrupter of claim 1 further comprising:

an insulating chamber in which the vacuum circuit interrupters are contained; and a plurality of bushings, through each of which one of the movable contacts or one of the fixed contacts extends from the insulating chamber.

4. The circuit interrupter of claim 1, wherein one or more of the vacuum circuit interrupters comprises:

a housing that provides a vacuum chamber and that comprises:

a first end cap, a second end cap that comprises a radial bellows, and an insulating sidewall that extends from the first end cap to the second end cap;

wherein:

the fixed contact extends through an opening of the first end cap and into the vacuum chamber, and the moveable contact extends through an opening of the second end cap and into the vacuum chamber.

5. The circuit interrupter of claim 4, wherein the radial bellows of one or more of the vacuum circuit interrupters comprises a plurality of concentric circular ridges that encircle the moveable contact of the vacuum circuit interrupter.

6. The circuit interrupter of claim 4, wherein the second end cap of one or more of the vacuum circuit interrupters:

comprises a metal; and further includes a wall that extends perpendicular to the radial bellows and that is fixedly connected to the insulating sidewall of the housing.

7. The circuit interrupter of claim 4, wherein the insulating sidewall of the housing of one or more of the vacuum circuit interrupters comprises glass or a ceramic material.

8. The circuit interrupter of claim 4, wherein one or more of the vacuum circuit interrupters further comprises a shield that is positioned in the housing to surround at least a portion of the fixed contact in the housing, a full distance of a gap formed when the fixed contact and the moveable contact are separated, and at least a portion of the moveable contact.

9. The circuit interrupter of claim 4, wherein the first end cap of one or more of the vacuum circuit interrupters:

comprises a metal; and further includes a wall that is parallel to the fixed contact and that is fixedly connected to the insulating sidewall of the housing.

10. The circuit interrupter of claim 4 wherein, for one or more of the vacuum circuit interrupters:

the housing includes a rim that encircles the first end cap; and the first end cap comprises a wall that extends through the rim and into the housing to form a wall of the vacuum chamber.

11. The circuit interrupter of claim 1, wherein the connecting member is configured as one of a disk, a plate, or a set of interconnected bars.

12. The circuit interrupter of claim 1, wherein the actuator is positioned relative to the planar array structure such that the actuator is configured to move the connecting member axially in the same direction as the direction of movement of the movable contacts.

13. The circuit interrupter of claim 1, wherein the planar array structure is in the form of one of a circular arrangement, a box arrangement, or a triangle arrangement.

14. A circuit interrupter, comprising:

a plurality of vacuum circuit interrupters positioned proximate to each other on a single plane in an array structure, wherein:

each of the vacuum circuit interrupters includes a fixed contact and a movable contact, the vacuum circuit interrupters are electrically connected to each other in a series between an input terminal and an output terminal, each vacuum circuit interrupter is a low voltage circuit interrupter, and the series provides a medium voltage circuit interrupter;

an insulating chamber in which the vacuum circuit interrupters are contained;

a plurality of bushings, through each of which one of the movable contacts or one of the fixed contacts extends from the insulating chamber;

a connecting member that comprises an insulating material and that is attached to the movable contacts of each of the vacuum circuit interrupters; and an actuator that is connected to the connecting member;

wherein the actuator is configured to move the connecting member in a first direction to close each of the interrupters, and to move the connecting member in a second direction to open each of the interrupters.

15. The circuit interrupter of claim 14, wherein the connecting member is configured as one of a disk, a plate, or a set of interconnected bars.

16. A circuit interrupter, comprising:

a plurality of vacuum circuit interrupters positioned proximate to each other in a planar array structure, wherein each of the vacuum circuit interrupters includes a fixed contact and a movable contact, and wherein the vacuum circuit interrupters are electrically connected to each other in a series between an input terminal and an output terminal;

a connecting member that comprises an insulating material and that is attached to the movable contacts of each of the vacuum circuit interrupters; and an actuator that is connected to the connecting member;

wherein:

the actuator is configured to move the connecting member in a first direction to close each of the interrupters, and to move the connecting member in a second direction to open each of the interrupters one or more of the vacuum circuit interrupters comprises:

a housing that provides a vacuum chamber and that comprises:

a first end cap, a second end cap that comprises a radial bellows, and an insulating sidewall that extends from the first end cap to the second end cap;

the fixed contact extends through an opening of the first end cap and into the vacuum chamber, the moveable contact extends through an opening of the second end cap and into the vacuum chamber, and for one or more of the vacuum circuit interrupters:

the housing includes a rim that encircles the first end cap; and the first end cap comprises a wall that extends through the rim and into the housing to form a wall of the vacuum chamber.

17. The circuit interrupter of claim 16, further comprising:

a first conductive link member that is configured to be electrically connected to the input terminal and to either the fixed contact or the moveable contact of a first one of the vacuum circuit interrupters in the series;

a second conductive link member that is configured to be electrically connected to the output terminal and to either the fixed contact or the moveable contact of a final one of the vacuum circuit interrupters in the series; and a plurality of additional conductive link members, each of which electrically connects either the fixed contacts or the moveable contacts of a pair of adjacent vacuum circuit interrupters in the series.

18. The circuit interrupter of claim 16, further comprising:

an insulating chamber in which the vacuum circuit interrupters are contained; and a plurality of bushings, through each of which one of the movable contacts or one of the fixed contacts extends from the insulating chamber.

19. The circuit interrupter of claim 16, wherein the radial bellows of one or more of the vacuum circuit interrupters comprises a plurality of concentric circular ridges that encircle the moveable contact of the vacuum circuit interrupter.

20. The circuit interrupter of claim 16, wherein the second end cap of one or more of the vacuum circuit interrupters:

comprises a metal; and further includes a wall that extends perpendicular to the radial bellows and that is fixedly connected to the insulating sidewall of the housing.

21. The circuit interrupter of claim 16, wherein the insulating sidewall of the housing of one or more of the vacuum circuit interrupters comprises glass or a ceramic material.

22. The circuit interrupter of claim 16, wherein one or more of the vacuum circuit interrupters further comprises a shield that is positioned in the housing to surround at least a portion of the fixed contact in the housing, a full distance of a gap formed when the fixed contact and the moveable contact are separated, and at least a portion of the moveable contact.

23. The circuit interrupter of claim 16, wherein the first end cap of one or more of the vacuum circuit interrupters:

comprises a metal; and further includes a wall that is parallel to the fixed contact and that is fixedly connected to the insulating sidewall of the housing.

24. The circuit interrupter of claim 16 wherein, for one or more of the vacuum circuit interrupters:

the housing includes a rim that encircles the first end cap; and the first end cap comprises a wall that extends through the rim and into the housing to form a wall of the vacuum chamber.

* * * * *